US006276876B1

(12) United States Patent
Bone et al.

(10) Patent No.: US 6,276,876 B1
(45) Date of Patent: Aug. 21, 2001

(54) OFFSHORE EXPLORATION OR PRODUCTION OPERATION

(75) Inventors: David Bone, Chepstow; Christopher Heywood, Dartmouth; Andrew Patrick Hollis, Goring on Thames, all of (GB)

(73) Assignee: BG plc, Reading (GB)

( * ) Notice: Subject to any disclaimer, the term of this patent is extended or adjusted under 35 U.S.C. 154(b) by 0 days.

(21) Appl. No.: 08/860,668

(22) PCT Filed: Nov. 5, 1996

(86) PCT No.: PCT/GB96/02707

§ 371 Date: Nov. 13, 1997

§ 102(e) Date: Nov. 13, 1997

(87) PCT Pub. No.: WO97/17496

PCT Pub. Date: May 15, 1997

(30) Foreign Application Priority Data

Nov. 6, 1995 (GB) ..... 9522722

(51) Int. Cl.[7] ..... B63B 35/44

(52) U.S. Cl. ..... 405/205; 405/207; 405/203; 114/264

(58) Field of Search ..... 114/264, 265, 114/266, 26, 65 A; 405/195.1, 200, 203, 204, 205, 206, 207, 209, 224

(56) References Cited

U.S. PATENT DOCUMENTS

| | | | | |
|---|---|---|---|---|
| 1,353,880 | * | 9/1920 | Widing | 114/65 A |
| 2,321,811 | * | 6/1943 | Harris | 114/65 A |
| 2,454,403 | * | 11/1948 | Palmieri | 114/65 A |
| 3,021,680 | * | 2/1962 | Hayward | 114/265 X |
| 3,593,529 | * | 7/1971 | Smulders | 114/265 X |
| 3,738,113 | | 6/1973 | Madary et al. | 61/46.5 |
| 3,815,540 | * | 6/1974 | Peereboom | 114/264 X |
| 3,961,489 | | 6/1976 | Mo | 61/46.5 |
| 4,085,695 | | 4/1978 | Bylo | 114/260 |
| 4,126,011 | * | 11/1978 | Lamy et al. | 405/205 X |
| 4,263,862 | * | 4/1981 | Shepherd | 114/65 A |
| 4,416,210 | * | 11/1983 | Lacy, Jr. et al. | 114/26 |
| 4,437,794 | | 3/1984 | Grimsley | 405/224 |
| 4,505,615 | * | 3/1985 | Evans | 405/205 |
| 4,575,281 | | 3/1986 | Oksuzler | 405/217 |
| 4,576,518 | * | 3/1986 | Cooke et al. | 405/205 |
| 4,579,481 | * | 4/1986 | Gerwick et al. | 405/205 X |
| 4,627,767 | | 12/1986 | Field | 405/196 |

FOREIGN PATENT DOCUMENTS

| | | |
|---|---|---|
| 1197762 | 7/1970 | (GB) . |
| 1337440 | 11/1973 | (GB) . |
| 1386327 | 3/1975 | (GB) . |
| 1551859 | 9/1979 | (GB) . |
| 2080860 | 2/1982 | (GB) . |
| 2186901 | 8/1987 | (GB) . |
| 2196675 | 5/1988 | (GB) . |
| WO 90/03470 | 4/1990 | (WO) . |

* cited by examiner

*Primary Examiner*—David Bagnell
*Assistant Examiner*—Frederick L. Lagman
(74) *Attorney, Agent, or Firm*—William H. Holt

(57) ABSTRACT

Apparatus for providing an offshore drilling operation in a sea, the apparatus comprising a drilling derrick support structure (2) having a base (4) to rest on the sea-floor (5) and a deck (7) to support a drilling derrick (1), the structure being in the form of a concrete block (2) having a hollow cavity to enable the block (2) to be floated to the site where drilling is to take place and being adapted to receive ballast into the cavity in such a way and in a sufficient quantity as to cause the block (2) to sink base-first and rest upon the sea-bed with the deck (7) clear of the surface of the sea, a drilling derrick (1) for mounting on the deck (7) of the block (2) and a tender assist barge (3) for transport to the site in down to 2 m of water to provide services, supplies and equipment to the drilling derrick (1).

11 Claims, 3 Drawing Sheets

Figure 1:
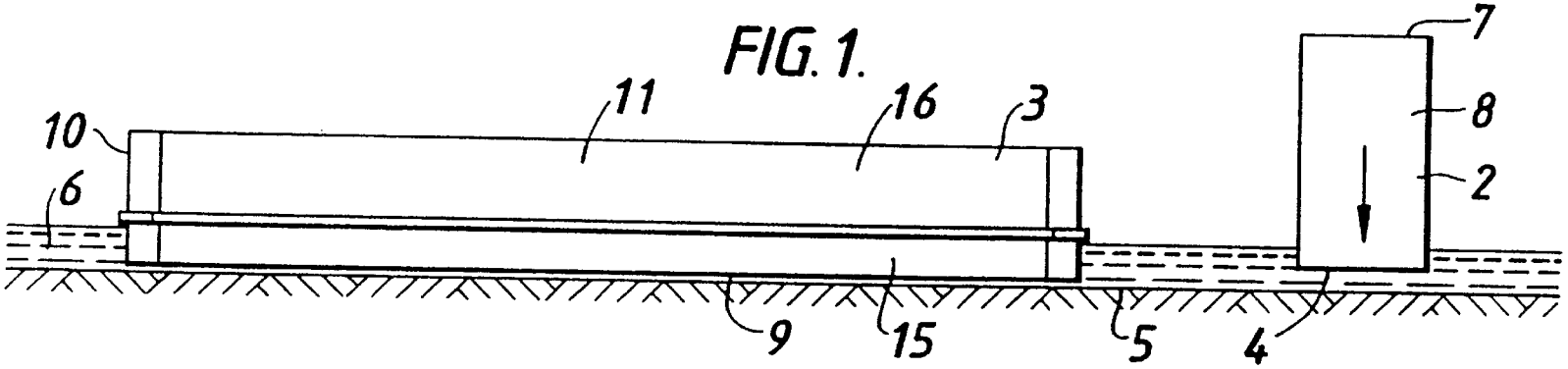

2
13
14
3
12
11
10

OFFSHORE EXPLORATION OR PRODUCTION OPERATION

The present invention relates to an apparatus and method for providing an offshore drilling operation for oil and gas in a sea particularly, though not exclusively, a shallow inland sea or lake.

By the term "shallow" we means that the sea depth varies between about 2 m and 10 m across the expanse of water. Such seas can have severe wave conditions. A typical such inland sea is the Caspian Sea.

While we have used the term "sea" throughout the specification it should be understood that the term "sea" also includes freshwater lakes and indeed any expanse of inland water.

It is known to explore for and produce oil and gas from shallow inland seas and lakes.

The normal methods involve the use of either a so-called swamp barge, alternatively a so-called jack-up rig, a tender assist drilling unit or the use of a platform based rig transported to a fixed platform and erected there to drill wells.

A swamp barge is a large flat bottomed vessel with a large surface area to draught ratio. As its name suggests it is mainly used in swampy areas where it is floated out to site with the drilling rig on board located on a raised deck. Drilling is conducted with the barge ballasted so that its bottom rests on the sea-bed. Operations are limited to water depths capable of floating the barge but not too deep to affect the raised deck.

A jack-up rig is a floating unit on which is mounted the drilling rig. The platform has retractable extending legs. With the legs retracted the platform is floated out on the surface of the sea to the site where drilling is to take place. When in position, the legs are extended to jack the platform up above the highest wave height expected and the legs are then temporarily fixed in position. As the legs must not foul the sea floor during the period when the platform is floated out to site, the minimum water depth for operations is restricted.

In general jack-up rigs are unsuitable for very shallow water.

A tender assist drilling unit is a barge supporting a drilling derrick and associated drilling equipment. The derrick is transferred onto a fixed platform to permit drilling supported by the services on the barge. This method is not used in very shallow water and is used in conjunction with permanent fixed platforms.

Wells may be drilled by the above methods in shallow water but each method is limited on the range of water depths accommodated.

Drilling may also be conducted on a fixed platform using a platform based rig erected on the platform for the purpose. The platform however must be large to accommodate the rig and is a permanent structure placed prior to the start of drilling which may be of uncertain outcome.

It is therefore an object of the present invention to provide an apparatus and method for providing an offshore drilling operation which overcomes the disadvantages of the above described prior art techniques.

According therefore to one aspect of the present invention, we provide apparatus for providing an offshore drilling operation in a sea, the apparatus comprising a drilling derrick support structure having a hollow cavity to enable the structure to be floated to the site where drilling is to take place and being adapted to receive ballast into the cavity in such a way and in a sufficient quantity as to cause the structure to sink base first and rest upon the sea-bed with the deck clear of the surface of the sea, a drilling derrick for mounting on the deck of the structure and a tender barge adapted for transport to the site in water depths down to 1½ m and to provide services and equipment to the drilling derrick.

According to a second aspect of the present invention in a method for providing an offshore drilling operation in a sea, the method comprises floating a buoyant drilling derrick support structure to the site where drilling is to take place, the structure having a base to rest on the sea floor and a deck spaced from the base sufficiently to support the derrick above sea-level when the base is resting on the sea-bed, ballasting the structure sufficiently to cause it to sink so that its base rests on the sea floor and its deck is clear of the surface of the sea, floating a drilling derrick out to the structure, positioning the derrick on the deck of the structure and floating a tender barge out to the site in water depths down to 1½ m to provide services and equipment to the drilling derrick.

Preferably the derrick support structure is a concrete gravity based structure and suitably the structure has a plurality of well conductors extending vertically through the structure to permit the passage of drill strings and production tubes therethrough.

The barge may be adapted for transport in water depths between 1½ m and 15 m.

The barge may have a so-called "key" slot which is a recess or niche in the bow of the vessel for receiving and engaging the derrick support structure during operations.

Suitably the barge has an inner casing of steel (as conventional) and an outer shell of a concrete based material. Such a shell protects the barge from the severe frosts and ice which occur in some areas of the world during winter, e.g. that area of Russia including the Caspian Sea.

Preferably at least one support barge is provided to link disengagably with the tender barge and suitably two such barges are provided.

Conveniently an accommodation barge is provided to link disengageably with the tender barge.

Figure 2:
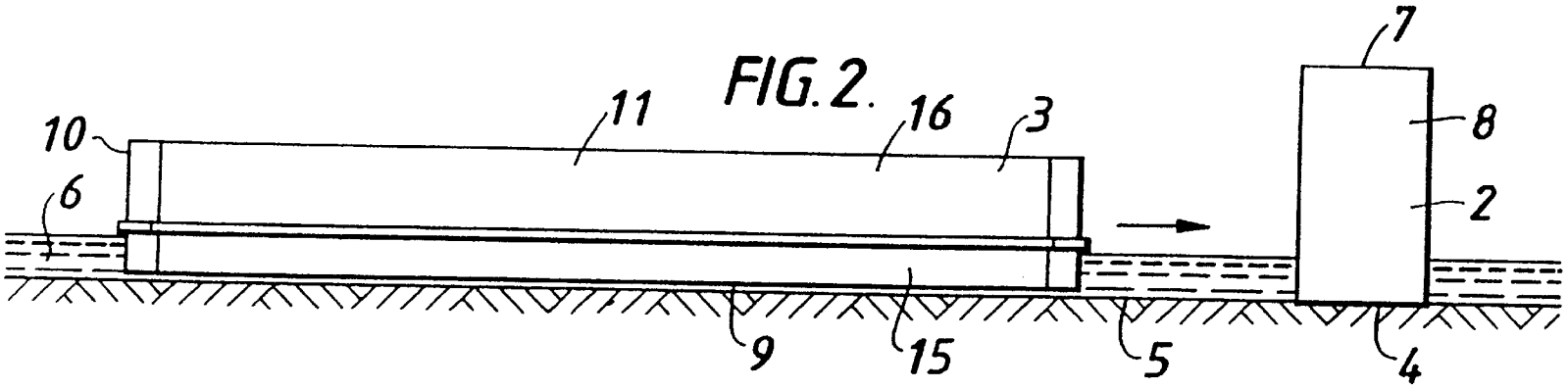
Figure 3:
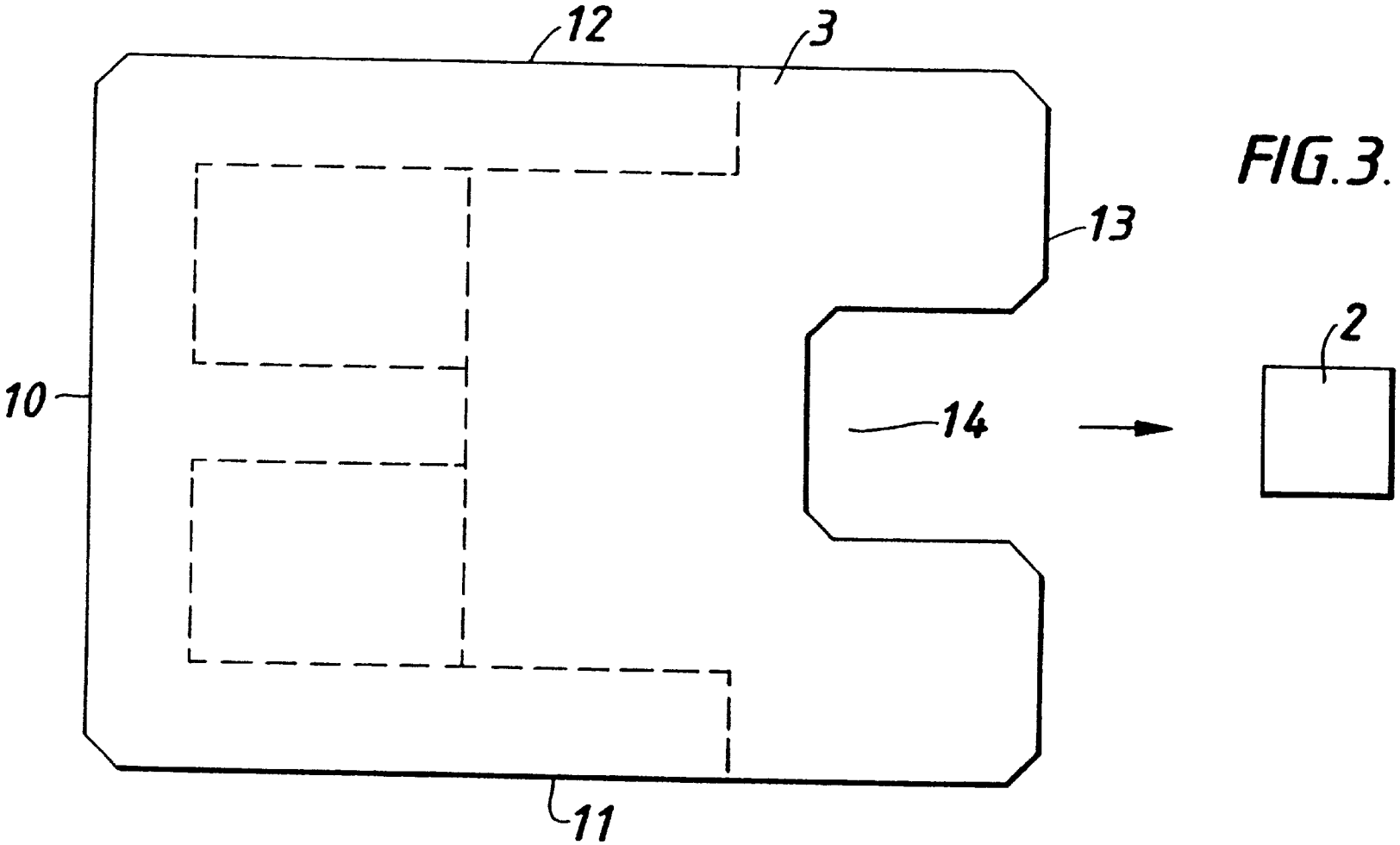
Figure 4:
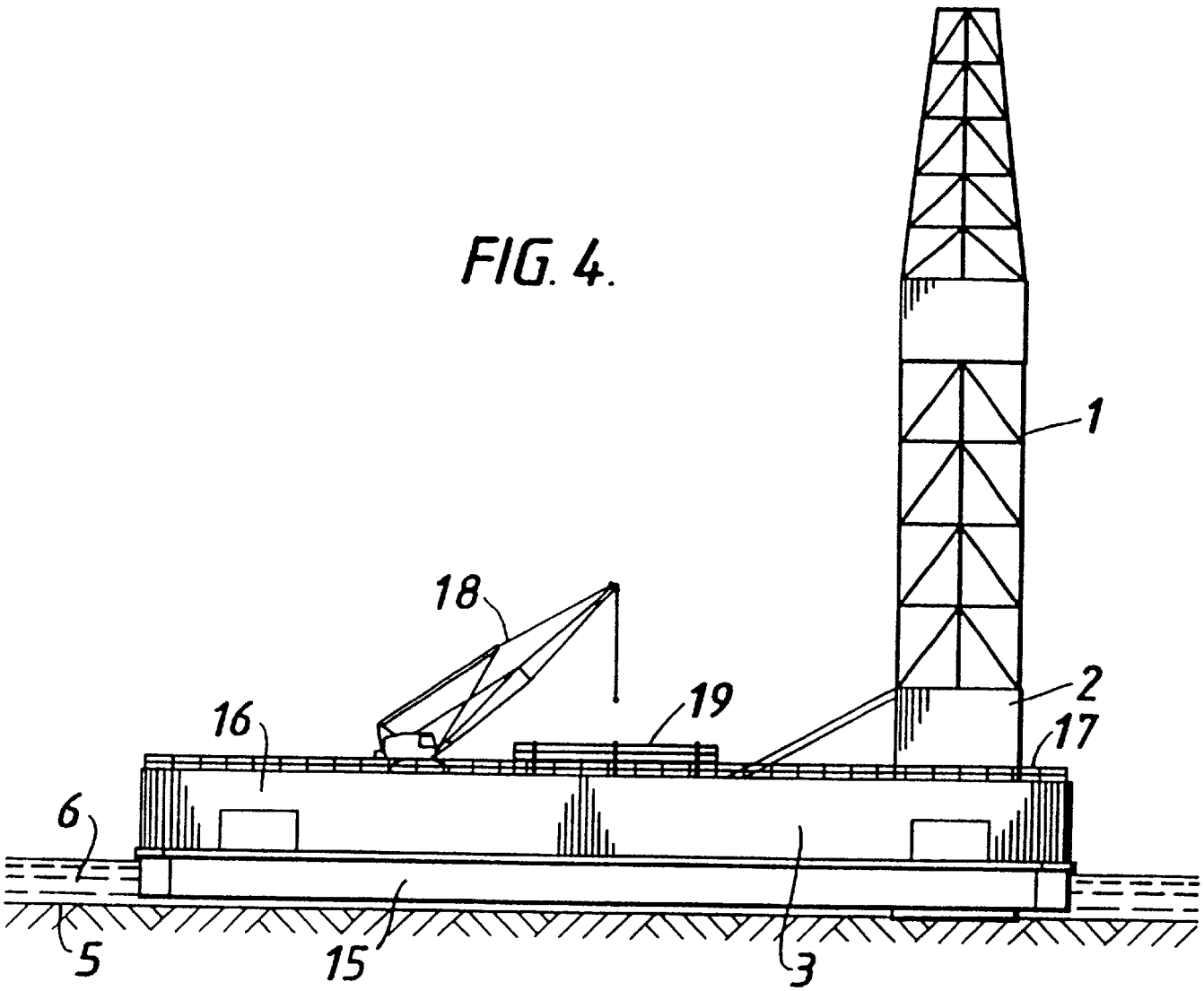

An embodiment of the invention will now be particularly described with reference to the drawings in which:

FIGS. 1 and 2 are schematic side views of a tender assist barge and a gravity based structure, FIG. 3 is a schematic plan view of the barge and the structure, and FIG. 4 is a side view of a barge and rig in operation at site.

Referring to the drawings the apparatus comprises a drilling derrick 1 (see FIG. 4), a gravity based structure 2 and a tender assist barge 3.

The derrick 1 is a quite standard, normally land based drilling rig, i.e. exploration or production derrick and will therefore not be described further.

The gravity based structure is also of standard design and is in the form of an elongated hollow block 2 in which surrounding concrete walls form a cavity (not shown). The block 2 is buoyant and can float on the water. The block 2 has a lowermost flat base 4 for resting on the bed 5 of the sea 6 and an uppermost flat deck 7 upon which in use is mounted the drilling derrick 1. The structure is capable of being ballasted in the well-known manner to rest on the sea-level.

Extending vertically through the block 2 from its deck to its base are four spaced well conductors (not shown) of well known design. These conductors open out at one end on block deck 7 and at the other end at the base 4 and as is equally well known provide channels for drill bits, strings and pipes to access the sea bed for drilling.

Clearly the height of the block 2 must be chosen so that when in position, the deck 7 is above the maximum expected sea-level and wave action.

The tender assist barge 3 comprises a flat bottomed vessel with generally a large surface area relative to the draught of the vessel. As seen most clearly in FIG. 2 and FIG. 3, the barge 3 has a flat bottom 9, a generally flat walled stern 10, two flat walled sides 11 and 12 and a bow 13 which forms a centrally located key slot or recess 14 to receive and engage the block 2. The bottom, stern, side walls and bow of the barge 3 comprise an inner casing of steel and an outer casing of concrete. The barge 3 is divided into two decks, a lower deck 15 and an upper deck 16.

On the lower deck 15 are located drilling support services and stores.

On the upper deck 16 are located pipe racks, offices and equipment for drilling operations.

As shown in FIG. 4 the upper deck 16 is provided with a guard rail 17 around its periphery. A crawler-type crane 18 is also provided for transporting components about the upper deck 16 and from the upper deck 16 of the barge 3 to the deck 7 of the block 2 and from the deck 7 to the deck 16. A pipe rack assembly 19 is also shown in FIG. 4.

To provide the offshore drilling facility the block 2 is first of all mounted on the barge 3 and is then floated out on the barge 3 from the shore to the selected site and is positioned on the sea (FIG. 1) by means of jacks mounted on the barge 3.

Then ballast is introduced into the block 2 in the known manner to cause it to sink base-first to the sea-floor (FIG. 2).

The tender barge 3 which lies off the block 2 while it is being lowered onto the sea-bed 5 is then moved into position so that the block 2 is located between the walls of the slot 14.

Before leaving shore the drilling derrick 1 is also mounted on the deck of the barge 3 and the barge 3 is loaded with other essential equipment and supplies including the crane 18 and other equipment already mentioned.

After the block 2 has been located on the sea-bed, the derrick 1 is skidded and jacked onto the deck 7 of the block 2. The tender barge 3 then stays in position with the block 2 retained in the slot 14, various items of equipment being supplied from the barge to the deck 7 of the block 2 to permit drilling to proceed.

While not shown, a standard support barge or two standard support barges can be floated out to the tender barge to provide restocking of equipment and other supplies.

One support barge can return to shore to restock while the other is stocking the tender barge.

In addition a standard accommodation barge can be floated out to the tender barge to provide accommodation for the crew.

The support and accommodation barges can be linked to the tender barge by gangplanks or the like to enable personnel to pass freely between the barges with or without stores, equipment and other items.

If the exploration drilling is unsuccessful the block can be left intact and the drilling derrick and tender barge can be disengaged and floated off to a different site for further exploration and if redundant the block can be removed from the sea-bed and transported to another drilling site.

Where a drilling phase using a block has been completed the block can be used on a production platform.

The apparatus described can provide an exploration and production facility in water varying between 2 and 10 meter in depth.

The concrete casing on the tender barge can provide protection against ice of up to 1 meter thick as is found in some inland sea locations.

The technique permits the use of a standard and land-based drilling derrick requiring few expensive modifications.

In some parts of the world, there is little or no sophisticated local manufacturing so all the components of any conventional drilling or production platform must be brought in at high cost. With the apparatus of the present invention all the components can be constructed by local low skill manufacturing and so costs are lower.

The derrick support structure can be used as a production platform. As further wells are required at this location additional support structures can be added in a variety of configurations to build up large multiwell platforms. However, the expansion can be easily adjusted to the success or otherwise of drilling at that location thereby avoiding the risky pre-installation of large platforms prior to a knowledge of the performance of that area of the field. Support structures without wells can also be used in a variety of ways as low cost production platform components in a modular field development.

What is claimed is:

1. Apparatus for providing an offshore drilling operation in a shallow sea, the apparatus comprising a drilling derrick support structure in the form of a block having a base to rest on the sea floor and a deck to support a drilling rig, said block having a hollow cavity to enable said support structure to be floated to the site where drilling is to take place and being adapted to receive ballast into said cavity in such a way and in a sufficient quantity as to cause said support structure to sink base first and rest upon the sea floor with said deck clear of the surface of the sea, a drilling derrick for mounting on the deck of the structure and a tender barge adapted for transport to the site in water depths down to 1½ meters to provide services and equipment to the drilling rig.

2. Apparatus as claimed in claim 1 in which the barge is adapted for transport in water depths between 1½ m and 15 m.

3. Apparatus as claimed in claim 1 in which the drilling derrick support structure is a concrete gravity based structure.

4. Apparatus as claimed in claim 3 in which the structure has a plurality of well conductors.

5. Apparatus as claimed in claim 1 in which the barge has a key slot adapted to receive and engage the rig support structure.

6. Apparatus as claimed in claim 1 in which the barge has an inner casing of steel and an outer casing of concrete.

7. A method for providing an offshore drilling operation in a sea, the method comprising floating a hollow buoyant drilling rig support structure to a site where drilling is to take place, said structure having a base to rest on the sea floor and a deck spaced from the base sufficiently to support a drilling derrick above sea level when said base is resting on said sea floor, ballasting said support structure sufficiently to cause it to sink so that said base rests on said sea floor and said deck is clear of the surface of the sea, floating a drilling derrick out to said support structure, positioning said derrick on the deck of said support structure and floating a tender barge to said site in water depths down to 1½ meters to provide services and equipment to the drilling derrick.

8. A method as claimed in claim 7 in which the water is at a depth of between 1½ m and 15 m.

9. A method as claimed in claim 8 in which said drilling derrick is mounted on the tender barge before being floated out on said barge to said support and is then transferred to said support structure.

10. A method as claimed in claim 7 in which said support structure is mounted on the tender barge before being floated out on the barge to said support structure.

11. A method as claimed in claim 7 in which the barge has a key slot adapted to receive and engage the support structure when the barge is moved towards the support structure after the structure has been located in position.

* * * * *